US009526131B2

(12) United States Patent
Kim et al.

(10) Patent No.: US 9,526,131 B2
(45) Date of Patent: Dec. 20, 2016

(54) MICROWAVE OVEN HAVING HOOD

(71) Applicant: LG ELECTRONICS INC., Seoul (KR)

(72) Inventors: Wontae Kim, Changwon-si (KR); Sungbae Song, Changwon-si (KR); Taeho Ji, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 704 days.

(21) Appl. No.: 13/929,913

(22) Filed: Jun. 28, 2013

(65) Prior Publication Data

US 2014/0042156 A1 Feb. 13, 2014

(30) Foreign Application Priority Data

Aug. 13, 2012 (KR) ..... 10-2012-0088460

(51) Int. Cl.
*H05B 6/64* (2006.01)

(52) U.S. Cl.
CPC ..... *H05B 6/6423* (2013.01)

(58) Field of Classification Search
CPC ..... H05B 6/6423; A01B 12/006
USPC ..... 219/68, 678, 679, 681, 702, 756, 757; 126/21 A, 21 R, 299 A, 299 D, 299 R, 273 A
See application file for complete search history.

(56) References Cited

U.S. PATENT DOCUMENTS

| | | | | |
|---|---|---|---|---|
| 9,307,582 | B2 * | 4/2016 | Yu | H05B 6/6408 |
| 2008/0100092 | A1 * | 5/2008 | Gao | E05F 15/60 296/146.11 |
| 2010/0200576 | A1 * | 8/2010 | Song | H05B 6/6423 219/756 |

FOREIGN PATENT DOCUMENTS

| | | | |
|---|---|---|---|
| CN | 2206913 | * | 9/1995 |
| EP | 0337935 | * | 9/1991 |
| EP | 2 541 154 | A1 | 1/2013 |
| KR | 10-2008-0043912 | A | 5/2008 |
| KR | 10-2008-0063568 | A | 7/2008 |
| KR | 10-1085499 | B1 | 11/2011 |

OTHER PUBLICATIONS

Korean Notice of Allowance issued in Appln. No. 10-2012-0088460 dated Jan. 27, 2014.

* cited by examiner

*Primary Examiner* — Dana Ross
*Assistant Examiner* — Joseph Iskra
(74) *Attorney, Agent, or Firm* — Ked & Associates LLP

(57) ABSTRACT

A microwave oven having a hood is provided. The microwave oven may more efficiently suction air containing contaminants, thereby more efficiently preventing diffusion of air containing contaminants. In addition, the microwave oven may tilt a tilting hood using a simplified construction.

18 Claims, 14 Drawing Sheets

MICROWAVE OVEN HAVING HOOD

CROSS-REFERENCE TO RELATED APPLICATION(S)

This application claims priority under 35 U.S.C. §119 to Korean Application No. 10-2012-0088460 filed on Aug. 13, 2012, whose entire disclosure is hereby incorporated by reference.

BACKGROUND

1. Field

This relates to a microwave oven.

2. Background

A microwave oven cooks food using microwaves. Some microwave ovens that also have a hood function are generally referred to as a microwave oven having a hood, or as an over-the-range (OTR) type microwave oven. Such a microwave oven having a hood function may include an exhaust function and a lighting function, in addition to the cooking function.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to various embodiments, examples of which are illustrated in the accompanying drawings. Wherever possible, the same reference numbers will be used throughout the drawings to refer to the same or like parts.

Figure 1:
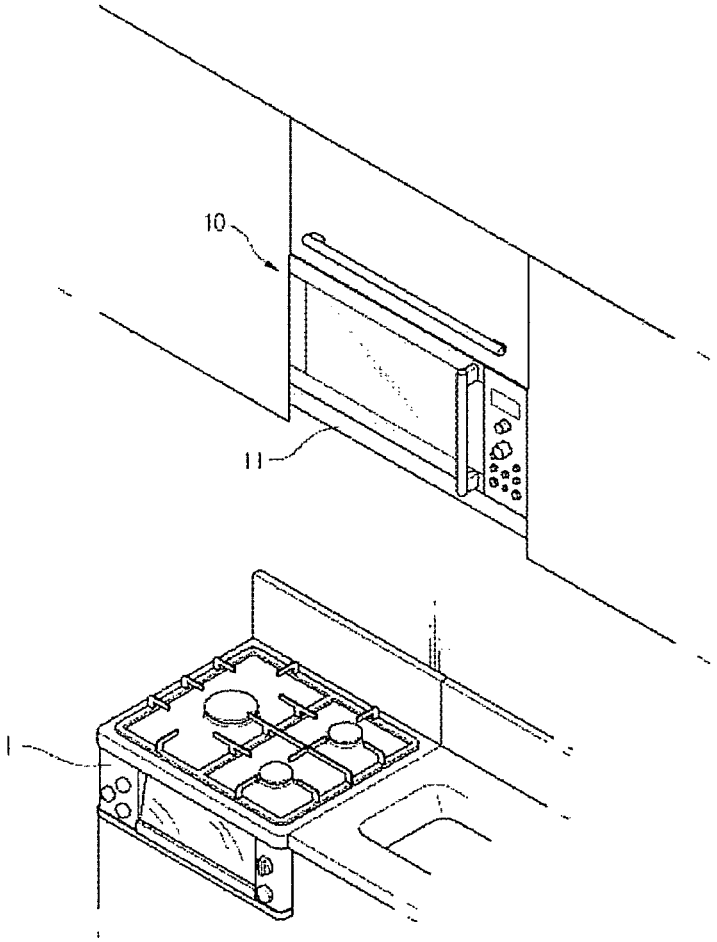
FIG. 1 is a perspective view of an exemplary kitchen in which an exemplary microwave oven having a hood is installed.

Referring to FIG. 1, a microwave oven 10 having a hood (hereinafter, simply referred to as a 'microwave oven') may be installed in a kitchen. More specifically, the microwave oven 10 may be installed above another cooking device 1, such as a conventional cooktop and oven, or range. The microwave oven 10 may include a hood 11 installed at the bottom of the microwave oven 10 to suction air containing contaminants generated during cooking on the cooking device 1. However, because the hood 11 is installed at the bottom of the microwave oven 10, it may be difficult to efficiently prevent diffusion of air containing contaminants to a region outside/near the hood 11. Additionally, because the bottom of the hood 11 is substantially flat, the distance between the rear end of the hood 11, which is located at the rear end of the bottom of the microwave oven 10, and the cooking device 1 may make it difficult for the hood 11 to efficiently suction contaminated cooking air from above the cooking device 1.

Figure 2:
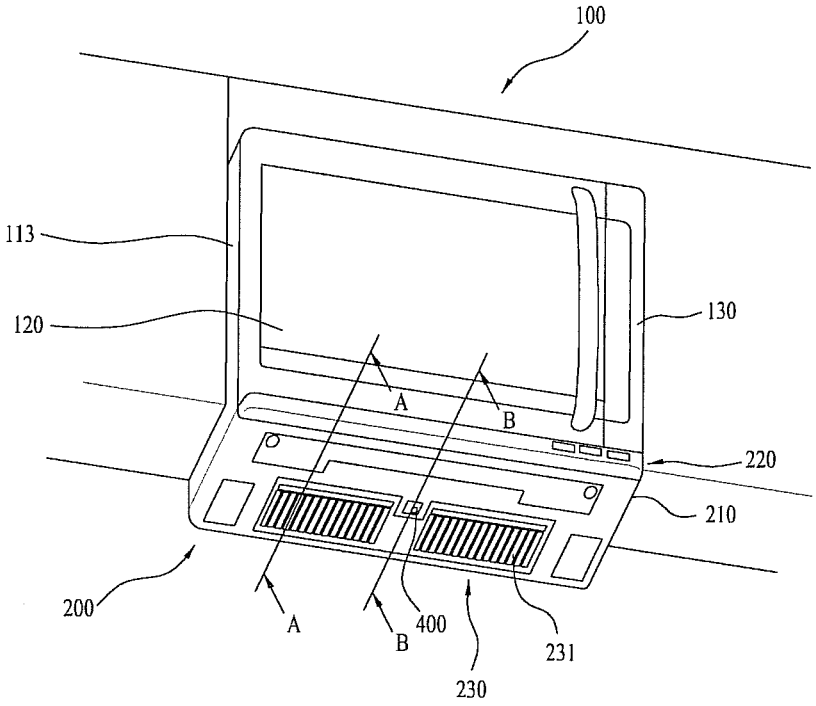
FIG. 2 is a perspective view of a microwave oven having a hood, according to an embodiment as broadly described herein.
Figure 3:
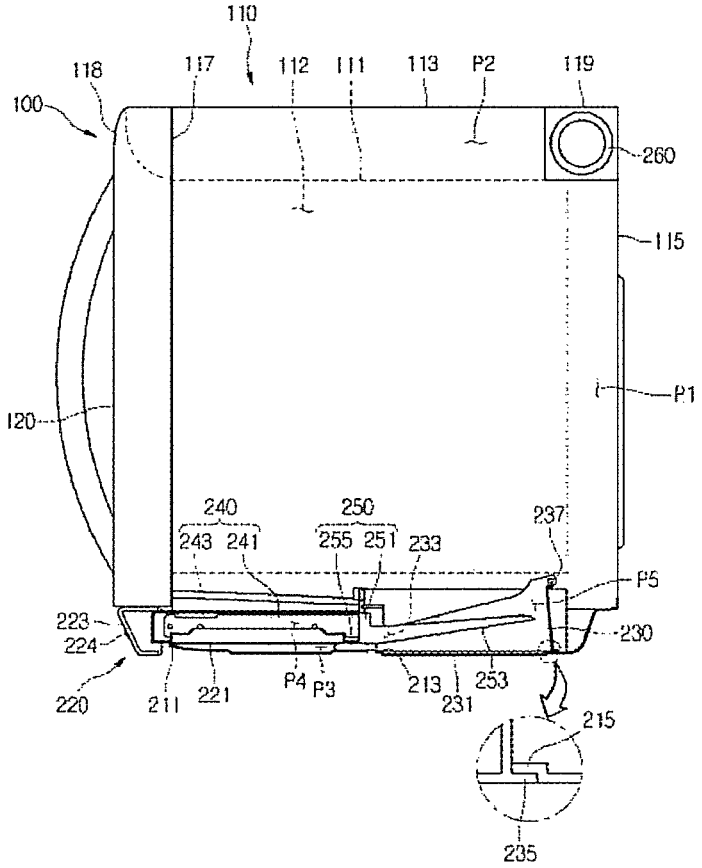
FIG. 3 is a longitudinal sectional view taken along line A-A of FIG. 2.

FIG. 2 is a perspective view of a microwave oven having a hood according to an embodiment as broadly described herein, and FIG. 3 is a longitudinal sectional view taken along line A-A of FIG. 2.

Referring to FIGS. 2 and 3, a microwave oven 100 having a hood (hereinafter, simply referred to as a 'microwave oven') may include a cavity 111 defined in a main body 110. The cavity 111 may be formed in a somewhat hexahedral shape and opened at the front thereof. In the cavity 111 is provided a cooking chamber 112 in which food is cooked.

The top and opposite lateral sides of the main body 110 are formed by an outer casing 113. In addition, the rear of the main body 110 is formed by a back plate 115. The top of the cavity 111 is spaced apart from the top of the outer casing 113. In addition, the rear of the cavity 111 is spaced apart from the front of the back plate 115. A connection channel P1 is defined between the rear of the cavity 111 and the front of the back plate 115. In addition, an indoor exhaust channel P2 is defined between the top of the cavity 111 and the top of the outer casing 113. Consequently, the upper end of the connection channel P1 communicates with the rear end of the indoor exhaust channel P2.

The main body 110 has an indoor exhaust port 117. The indoor exhaust port 117 is formed at the upper end of the front of the main body 110. The indoor exhaust port 117 serves as an outlet to discharge air from the main body 110 indoors.

In addition, an exhaust grill 118 is provided at the front of the indoor exhaust port 117. The exhaust grill 118 guides air exhausted through the indoor exhaust port 117 upward. The exhaust grill 118 is covered by a door 120 when the door 120 covers the cooking chamber 112. Air discharged indoors through the indoor exhaust port 117 may be guided forward by the exhaust grill 118. In this case, the exhaust grill 118 is not covered by the door 120.

An outdoor exhaust port 119 is formed at the top of the outer casing 113. The outdoor exhaust port 119 serves as an outlet to discharge air from the main body 110 outdoors. The outdoor exhaust port 119 is formed by cutting a portion of the top of the outer casing 113 immediately above the connection channel P1. A duct may be connected to the outdoor exhaust port 119 such that air discharged through the outdoor exhaust port 119 is discharged outdoors through the duct.

The door 120 is rotatably coupled to the main body 110 to selectively open and close the cooking chamber 112. For example, the door 120 may be rotated with respect to the main body about a vertical axis, in a side swing fashion.

In addition, a control panel 130 may be installed at the front of the main body 110 to receive a signal to operate the microwave oven 100 and to display information regarding the operation of the microwave oven 100.

A hood unit 200, or hood assembly 200, may be provided at the lower part of the main body 110. The hood unit 200 may suction air containing contaminants generated during cooking food on the cooking device 1 (see FIG. 1) installed below the microwave oven 100 into the main body 110. The hood unit 200 may include a hood casing 210, first and second hoods 220 and 230, a guide 240, and a tilting controller 250.

More specifically, the hood casing 210 may have a somewhat polyhedral shape opened at the top thereof. The hood casing 210 is fixed to the bottom of the main body 110. Consequently, a space to receive the first and second hoods 220 and 230 and a main intake channel P3, along which air suctioned into the main body 110 flows, are defined between the bottom of the main body 110 and the inside of the hood casing 210. The rear end of the main intake channel P3 communicates with the lower end of the connection channel P1.

A first entrance and exit port 211 is formed at the front of the hood casing 210. In addition, a second entrance and exit port 213 is formed at the bottom of the hood casing 210. The first entrance and exit port 211 is formed by cutting a portion of the front of the hood casing 210. The first entrance and exit port 211 serves as an entrance and exit through which the first hood 220 is received in the hood casing 210 and is withdrawn from the hood casing 210. The second entrance and exit port 213 is formed by cutting a portion of the rear end of the bottom of the hood casing 210. The second entrance and exit port 213 serves as an entrance and exit through which the second hood 230 is received in the hood casing 210 and is withdrawn from the hood casing 210.

In addition, a catching rib 215 is provided at the hood casing 210. The catching rib 215 is located at one side of the rear end of the hood casing 210 corresponding to the second entrance and exit port 213. Specifically, the catching rib 215 is spaced apart upward from the bottom of the hood casing 210 by a predetermined distance. For example, the catching rib 215 may be spaced apart upward from the bottom of the hood casing 210 by a distance corresponding to the thickness of a first stopper 235.

The first hood 220 is installed so as to be received in and withdrawn from the hood casing 210 through the first entrance and exit port 211. More specifically, the first hood 220 slides forward and backward with respect to the hood casing 210 (or the main body 110). Hereinafter, a position at which the first hood 220 is fully received in the hood casing 210 will be referred to a first storage position (see FIG. 3) and a position at which the first hood 220 is withdrawn from the hood casing 210 will be referred to a first withdrawn position (see FIG. 5).

The first hood 220 is formed in a somewhat polyhedral shape having a longitudinal section corresponding to the first entrance and exit port 211 and opened at the rear thereof. A first intake channel P4 is defined in the first hood 220. The rear end of the first intake channel P4 communicates with the front end of the main intake channel P3 when the first hood 220 is located at the first withdrawn position, at which the first hood 220 is withdrawn from the hood casing 210. The first intake channel P4 may be defined only when the first hood 220 is withdrawn from the hood casing 210, i.e. in a state in which the first hood 220 is located at the first withdrawn position.

In addition, a first intake port 221 is formed at the first hood 220. The first intake port 221 suctions air containing contaminants into the first intake channel P4. The first intake port 221 is located outside the hood casing 210 when the first hood 220 is at the first withdrawn position, at which the first hood 220 is withdrawn from the hood casing 210.

A front panel 223 is provided at the front of the first hood 220. The front panel 223 substantially defines the front of the first hood 220. A manipulation button 224 to receive a signal to operate the microwave oven 100 may be provided at the front panel 223. For example, a signal to operate a suction fan assembly 260, or a lamp, may be input through the manipulation button 224.

The second hood 230 is installed so as to be received in and withdrawn from the hood casing 210. More specifically, the second hood 230 tilts at a predetermined angle with respect to the hood casing 210 (or the main body 110). In this embodiment, the second hood 230 is selectively received in and withdrawn from the hood casing 210. In this embodiment, the second hood 230 is rotated, due to weight thereof, to tilt with respect to the hood casing 210. Hereinafter, a position at which the second hood 230 is received in the hood casing 210 will be referred to as a second storage position (see FIG. 3) and a position at which the second hood 230 is fully withdrawn from the hood casing 210 will be referred to as a second withdrawn position (see FIG. 5).

The second hood 230 may be formed in a somewhat polyhedral shape having a cross section corresponding to the second entrance and exit port 213 and opened at the front and top thereof. The second hood 230 substantially defines a second intake channel P5. When the second hood 230 is withdrawn from the hood casing 210, the upper end of the second intake channel P5 communicates with the rear end of the main intake channel P3. Similarly to the first intake channel P4, the second intake channel P5 may be defined only in a state in which the second hood 230 is withdrawn from the hood casing 210, i.e. when the second hood 230 is in the second withdrawn position.

In a state in which the second hood 230 is received in the hood casing 210, the bottom of the second hood 230 is located on a virtual plane having the same level as the bottom of the hood casing 210. In alternative embodiments, the bottom of the second hood 230 may be located on a virtual plane parallel to the bottom of the hood casing 210 when the second hood 230 is received in the hood casing 210. On the other hand, in a state in which the second hood 230 is withdrawn from the hood casing 210 while tilting at a predetermined angle with respect to the hood casing 210, the bottom of the second hood 230 may be located on a virtual plane tilting at a predetermined angle with respect to the bottom of the hood casing 210 such that the bottom of the second hood 230 is directed forward.

In addition, a second intake port 231 is formed at the second hood 230. The second intake port 231 suctions air containing contaminants into the second intake channel P5. Consequently, the second intake port 231 is located on a virtual plane that is at substantially the same level or parallel to the bottom of the hood casing 210 or a virtual plane tilting at a predetermined angle with respect to the bottom of the hood casing 210 such that the second intake port 231 is directed forward based on whether the second hood 230 retracted or extended.

Tilting pins 233 are provided at opposite sides of the second hood 230. The tilting pins 233 function as a tilting center, or rotation axis, of the second hood 230 received in and withdrawn from the hood casing 210. The tilting pins 233 extend outward in opposite direction from front ends of the opposite sides of the second hood 230. In addition, the tilting pins 233 are rotatably supported in the hood casing 210.

In addition, first and second stoppers 235 and 237 are provided at the rear end of the bottom of the second hood 230 and at the upper end of the rear of the second hood 230, respectively. During storage in and withdrawal from the hood casing 210, the first and second stoppers 235 and 237 selectively come into contact with the catching rib 215 to restrict a tilt angle of the second hood 230.

More specifically, the first stopper 235 extends backward from the bottom of the second hood 230 to prevent the second hood 230 from being received farther inward in the hood casing 210 than the second storage position. To this end, the top of the first stopper 235 comes into contact with the bottom of the catching rib 215 during storage of the second hood 230 in the hood casing 210.

In this embodiment, the catching rib 215 is spaced apart in an upward direction from the bottom of the hood casing 210 by a distance corresponding to the thickness of the first stopper 235. In a state in which the top of the first stopper 235 is in contact with the bottom of the catching rib 215, i.e. the second hood 230 is located at the second storage position, therefore, the bottom of the second hood 230 is located on substantially the same virtual plane as the bottom of the hood casing 210.

The second stopper 237 extends backward from the upper end of the rear of the second hood 230 to prevent the second hood 230 from being withdrawn farther outward from the hood casing 210 beyond the second withdrawn position. To this end, the bottom of the second stopper 237 comes into contact with the top of the catching rib 215 during withdrawal of the second hood 230 from the hood casing 210.

The guide member 240 serves to guide storage and withdrawal of the first hood 220 in and from the hood casing 210, i.e. sliding of the first hood 220 with respect to the hood casing 210. A rail assembly including first and second rails 241 and 243 may be used as the guide member 240. The first rails 241 are fixed inside opposite sides of the hood casing 210. The second rails 243 are fixed outside the opposite sides of the hood casing 210. As the second rails 243 slide along the first rails 241, the first hood 220 slides forward and backward with respect to the hood casing 210. For this reason, the first rails 241 and the second rails 243 may be referred to as fixed rails and movable rails, respectively. However, the rail assembly having the above-stated construction is not the only arrangement which may be used as the guide member 240. That is, the guide member 240 is not particularly restricted so long as the guide member 240 may guide movement of the first hood 220. For example, the guide member 240 may include rails provided at the bottom of the hood casing 210 and rollers provided at opposite sides of the first hood 220 so as to move along the rails.

The tilting controller 250 may selectively allow or restrict storage and withdrawal of the second hood 230 from the hood casing 210 due to weight. In addition, the tilting controller 250 may guide storage and withdrawal of the second hood 230. When the first hood 220 is located at a first position at which the first hood 220 is received in the hood casing 210, the tilting controller 250 substantially restricts withdrawal of the second hood 230 from the hood casing 210. On the other hand, when the first hood 220 is located at a second position at which the first hood 220 is withdrawn from the hood casing 210, the tilting controller 250 allows the second hood 230 to be withdrawn from the hood casing 210 due to weight thereof and guides withdrawal of the second hood 230 from the hood casing 210. In other words, the tilting controller 250 may selectively transmit an external force generated by the first hood 220 due to weight thereof to the second hood 230. The tilting controller 250 includes first and second locking members 251 and 255.

More specifically, the first locking member 251 is provided at the first hood 220. The second locking member 255 is provided at the second hood 230. The first and second locking members 251 and 255 move relative to each other in contact according to storage and withdrawal of the first hood 220 to guide storage and withdrawal of the second hood 230. To this end, lengths of the first and second locking members 251 and 255 may be decided within a range in which the first and second locking members 251 and 255 may contact each other in a state in which the first hood 220 is located at the first withdrawn position relative to the hood casing 210. In addition, lengths of the first and second locking members 251 and 255 may be decided within a range in which interference between the first hood 220 and the hood casing 210 or between the first hood 220 and the second hood 230 may be avoided in a state in which the first hood 220 is located at the first storage position at which the first hood 220 is received in the hood casing 210. In addition, the front end of the first locking member 251 may be located at least at the front of the second intake port 231 in a state at which the first hood 220 is located at the first withdrawn position in which the first hood 220 is withdrawn from the hood casing 210.

The first locking member 251 extends backward from the rear end of the first hood 220. A locking side and a guide side 253 are provided at the bottom of the first locking member 251. The locking side is located at the front end of the first locking member 251. For example, the locking side may have a predetermined area in the horizontal direction. The guide side 253 is inclined upward at a predetermined angle from the rear end of the locking side to the rear of the first hood 220.

The second locking member 255 extends forward from the front end of the second hood 230, substantially from the front end of the second hood 230 corresponding to the front of each of the tilting pins 233. The second locking member 255 may be substantially integrally formed at the bottom of the second hood 230. The second locking member 255 contacts the first locking member 251, substantially the locking side and the guide side 253. According to withdrawal of the first hood 220 from the hood casing 210, the second locking member 255 relatively moves along the guide side 253 in contact with the guide side 253.

That is, the second locking member 255 contacts the locking side in a state in which the first hood 220 is located at the first storage position at which the first hood 220 is received in the hood casing 210. In a state in which the second locking member 255 contacts the locking side as described above, tilting of the second hood due to weight thereof is restricted with the result that the second hood 230 remains located at the second storage position.

When the first hood 220 is withdrawn from the hood casing 210, i.e. the first hood 220 moves from the first storage position at which the first hood 220 is received in the hood casing 210 to the first withdrawn position in which the first hood 220 is withdrawn from the hood casing 210, the second locking member 255 is separated from the locking side with the result that tilting of the second hood 230 due to weight thereof is allowed. At this time, the second locking member 255 relatively moves along the guide side 253 in contact with the guide side 253 to guide withdrawal of the second hood 230 from the hood casing 210, i.e. tilting of the second hood 230. In other words, as the second locking member 255 relatively moves along the guide side 253, the second hood 230 moves from the second storage position at which the second hood 230 is received in the hood casing 210 to the second withdrawn position in which the second hood 230 is withdrawn from the hood casing 210. At this time, the second locking member 255 relatively moves along the guide side 253, and therefore, tiling velocity of the second hood 230 may be reduced.

In certain embodiments, the hood unit 200 may further include a drive unit, or driver, that controls storage and withdrawal of the first hood 220 from the hood casing 210. Alternatively, a user may directly store and withdraw the first hood 220 without such a driver.

For example, the driver may include a drive member and a drive force transmission member. The drive member generates drive force to store and withdraw the first hood 220 from the hood casing 210 through user manipulation. The drive force transmission member transmits the drive force generated by the drive member to the first hood 220. For example, a drive motor may be used as the drive member and one or more gears may be used as the drive force transmission member.

As another example, the driver may include an elastic member and a locking device. The elastic member provides elastic force in the direction in which the first hood 220 is withdrawn from the hood casing 210, i.e. the direction in which the first hood 220 moves to the first withdrawn position, to the first hood 220. Consequently, the first hood 220 is withdrawn from the hood casing 210 by the elastic force of the elastic member. The locking device may prevent the first hood 220 from arbitrarily moving to the first withdrawn position at which the first hood 220 is withdrawn from the hood casing 210 due to the elastic force of the elastic member in a state in which the first hood 220 is received in the hood casing 210, i.e. a state in which the first hood 220 is located at the first storage position. In other words, the locking device may selectively allow sliding of the first hood 200 due to the elastic force of the elastic member in a state in which the first hood 220 is located at the first storage position. For example, a coil spring or a leaf spring may be used as the elastic member. Opposite ends of the coil spring may be fixed to the hood casing 210 and the first hood 220 or the first and second rails 241 and 243. The leaf spring may be wound on a drum installed in the hood casing 210 in a state in which one end of the leaf spring is fixed to the first hood 220. In addition, the locking device may include a latch module and a latch hook. The latch module may be fixed to the hood casing 210 and the latch hook may be fixed to the first hood 220. The latch hook may selectively engage the latch module by external force applied to the first hood 220 in the direction in which the first hood 220 is received in the hood casing 210, and therefore, sliding of the first hood 220 with respect to the hood casing 210 is selectively allowed.

In addition, the hood unit 200 may further include a lamp. The lamp may illuminate the cooking device 1 below the microwave oven 100. The lamp may be installed at least one of the hood casing 210, the first hood 220, or the second hood 230.

A suction fan assembly 260 may be installed in the main body 110. The suction fan assembly 260 suctions air containing contaminants into the main body 110 and discharges the air from the main body 110 either indoors or outdoors, depending on arrangement of exhaust components. That is, when the suction fan assembly 260 is driven, air containing contaminants is suctioned into the main body 110 through the first and second intake ports 221 and 231. As the suction fan assembly 260 is continuously driven, the air containing contaminants, suctioned into the main body 110, flows along the man intake channel P3, the first and second intake channels P4 and P5, the connection channel P1 or/and the indoor exhaust channel P2 and is discharged indoors or outdoors through the indoor exhaust port 117 or the outdoor exhaust port 119. In this embodiment, the suction fan assembly 260 is installed at a connection between the connection channel P1 and the indoor exhaust channel P2.

Hereinafter, operation of the microwave oven having the hood according to the first embodiment will be described in detail with reference to the accompanying drawings.

Figure 4:
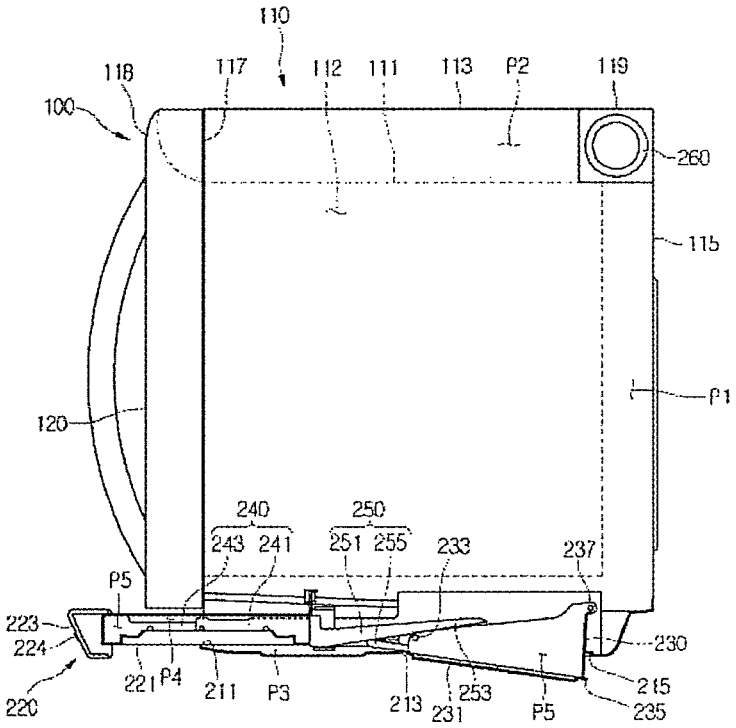
FIGS. 4 and 5 are longitudinal sectional views taken along line A-A of FIG. 2, illustrating operation of the hood.

Referring first to FIG. 4, a user withdraws the first hood 220 from the hood casing 210 from received positions in the hood casing 210 (see FIG. 3), i.e. in a state in which the first and second hoods 220 and 230 are located at the first and second storage positions, respectively. In a case in which an additional driver is provided, the first hood 220 may be withdrawn from the hood casing 210 by driving the driver (for example, by driving a drive motor or releasing a locked state of a locking device). As the first hood 220 is withdrawn from the hood casing 210, i.e. as the first hood 220 moves to the first withdrawn position, the second hood 230 is also withdrawn from the hood casing 210, i.e. the second hood 230 moves to the second withdrawn position.

Figure 5:
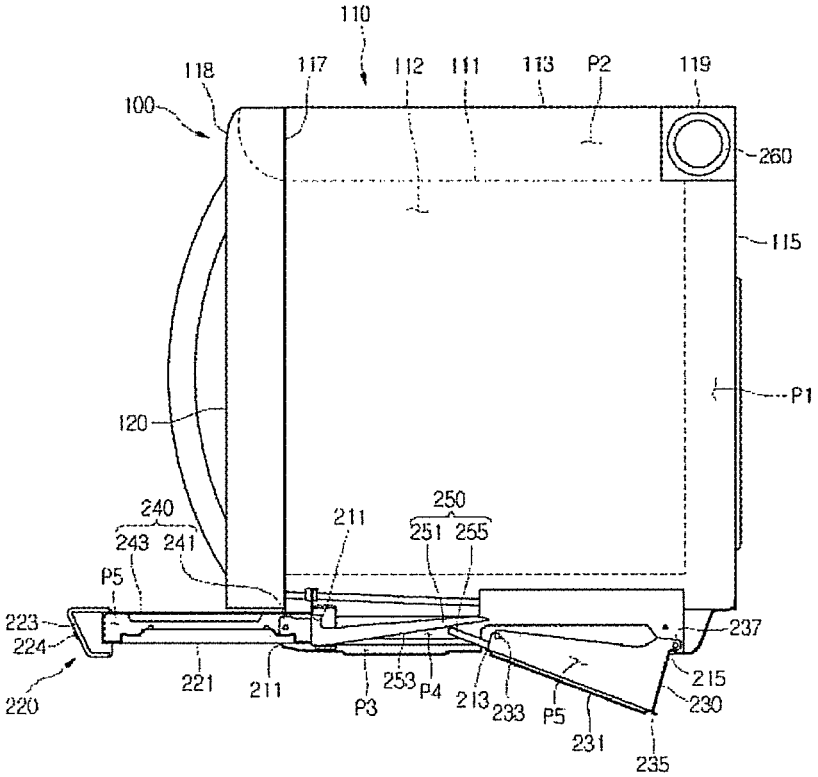

More specifically, the first hood 220 moves from the first storage position shown in FIG. 3 to the first withdrawn position, i.e., the first hood 220 moves to the left in the side sectional views shown in FIGS. 4 and 5. At this time, withdrawal of the first hood 220 is guided by the guide member 240. That is, when the first hood 220 moves to the left, the second rails 243 move to the left along the first rails 241 to guide withdrawal of the first hood 220.

When the first hood 220 is located at the first storage position at which the first hood 220 is received in the hood casing 210, the second hood 230 remains at the second storage position at which the second hood 230 is received in the hood casing 210 by the tilting controller 250. That is, the second locking member 255 maintains contact with the locking side, and therefore, tilting of the second hood 230 about the tilting pins 233 due to weight thereof is prevented.

When the first hood 220 is withdrawn from the hood casing 210 in this state, the first hood 220 moves to the left as shown in FIGS. 4 and 5, and therefore, the second locking member 255 comes into contact with the bottom, i.e. the guide side 253, of the first locking member 251. According to continuous movement of the first hood 220, the second locking member 255 moves along the guide side 253. As a result, the second hood 230 is rotated about the tilting pins 233, i.e. the second hood 230 tilts, and therefore, the second hood 230 is withdrawn from the hood casing 210. When withdrawal of the first hood 220 is completed, i.e. the first hood 220 is located at the first withdrawn position at which the first hood 220 is withdrawn from the hood casing 210, tilting of the second hood 230 is substantially completed. In this embodiment, however, the second stopper is caught by the catching rib 215 even when the first hood 220 is abnormally withdrawn from the hood casing 210 with the result that the second hood 230 remains at the second withdrawn position.

When the suction fan assembly 260 is operated with the first and second hoods 220 and 230 both withdrawn from the hood casing 210 as described above, air containing contaminants is suctioned into the main body 110 through the first and second intake ports 221 and 231. The suctioned air containing contaminants flows along the main intake channel P3 or the first and second intake channels P4 and P5 and the main intake channel P3 and is transmitted to the connection channel P1. The air containing contaminants, transmitted to the connection channel P1, flows along the indoor exhaust channel P2 and is discharged indoors through the indoor exhaust port 117 or outdoors through the outdoor exhaust port 119.

Meanwhile, a process of receiving the first and second hoods 220 and 230 back into the hood casing 210, i.e. a process of moving the first and second hoods 220 and 230 from the first and second withdrawn positions to the first and second storage positions, is carried out in order reverse to the above withdrawal process. That is, when the user applies external force to the first hood 220 in the direction in which the first hood 220 is received back into the hood casing 210, i.e. to the right in FIGS. 4 and 5, the first hood 220 is received in the hood casing 210. During storage of the first hood 220 in the hood casing 210 as described above, the second rails 243 move to the right along the first rails 241.

In addition, when the first hood 220 moves to the right of the drawing such that the first hood 220 is received in the hood casing 210, the second locking member 255 relatively moves along the guide side 253. As a result, the second hood 230 is rotated from the second withdrawal position at which the second hood 230 is withdrawn from the hood casing 210 in the direction in which the second hood 230 is received in the hood casing 210. When the first hood 220 is located at the first storage position at which the first hood 220 is received in the hood casing 210, the second locking member 255 comes into contact with the locking side with the result that the second hood 230 is located at the second reception position at which the second hood 230 is received in the hood casing 210. When the second hood 230 is located at the second storage position at which the second hood 230 is received in the hood casing 210, the first stopper 235 is caught by the catching rib 215 with the result that further movement of the second hood 230 into the hood casing 210 is prevented.

As shown in FIG. 2, the tiling controller 250 includes a tilt angle restriction device 400 installed adjacent to a rotational center thereof about which the second hood 230 tilts to restrict a tilt angle of the second hood 230.

Since the tilt angle restriction device 400 is installed at a rotational center of the tiling controller 250 about which the second hood 230 tilts, the tilt angle of the second hood 230 may be efficiently restricted even in a case in which the size of the tilt angle restriction device 400 is relatively small. This is because when the second hood 230 tilts about the rotational center of the tiling controller 250, the second hood 230 has the same angle but the smallest movement distance.

The tilt angle restriction device 400 may be provided at an intermediate portion, such as at the middle, of the hood casing 210 in the lateral direction. In a case in which the tilt angle restriction device 400 is provided at the middle of the hood casing 210, the second hood 230 may be supported such that the tilt angle of the second hood 230 is maintained equally at the left and right sides thereof by only one tilt angle restriction device 400. On the other hand, in a case in which the tilt angle restriction device 400 is eccentrically provided at one side of the hood casing 210, it may be necessary to provide at least two tilt angle restriction devices 400.

As shown in FIG. 5, the tilt angle restriction device 400 may restrict movement of the second hood 230 such that the second hood 230 does not tilt to the second withdrawn position but tilting of the second hood 230 is stopped before the second hood 230 reaches the second withdrawn position. That is, if the tilt angle restriction device 400 is not provided, the second hood may be withdrawn to the second withdrawn position shown in FIG. 5 but the tilt angle of the second hood 230 may be reduced through the adjustment of the tilt angle restriction device 400.

Various examples of the tilt angle restriction device are sown in FIGS. 6A-6D.

Figure 6A:
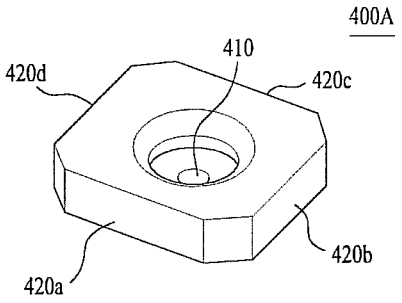
FIGS. 6A-6D are perspective views of exemplary tilt angle restriction devices.

Referring first to FIG. 6A, the tilt angle restriction device 400A may be configured such that a rotational center 410 is provided at the center of the tilt angle restriction device 400A to provide for rotation about the rotational center 410.

The horizontal section of the tilt angle restriction device 400A may be polygonal. That is, the horizontal section of the tilt angle restriction device 400A may include a plurality of segments arranged so as to form an acute angle therebetween.

A fixing member, such as a bolt, may be installed at the rotational center 410 such that the tilt angle restriction device 400A may be rotatably fixed to the hood casing 210.

The tilt angle restriction device 400A may include a plurality of sides 420*a*, 420*b*, 420*c*, and 420*d* having different radii about the rotational center 410. Each of the sides 420*a*, 420*b*, 420*c*, and 420*d* is formed in a quadrangular shape. Perpendicular distances from the rotational center 410 to the sides 420*a*, 420*b*, 420*c*, and 420*d* may be different from one another. When the second hood 230 contacts one of the sides 420*a*, 420*b*, 420*c*, and 420*d*, therefore, the tilt angle of the second hood 230 is restricted by the corresponding one of the sides 420*a*, 420*b*, 420*c*, and 420*d*.

The tilt angle of the second hood 230 may be differently restricted by the sides 420*a*, 420*b*, 420*c*, and 420*d*. For example, in a case in which the tilt angle of the second hood 230 is restricted by the side 420*a* having the smallest distance from the rotational center 410, the second hood 230 may tilt at a relatively large angle. On the other hand, in a case in which the tilt angle of the second hood 230 is restricted by the side 420*d* having the largest distance from the rotational center 410, the second hood 230 may tilt at a relatively small angle.

In certain embodiments, the sides 420*a*, 420*b*, 420*c*, and 420*d* may have different lengths and may be randomly arranged, unlike what is shown in FIG. 6A.

Figure 6B:
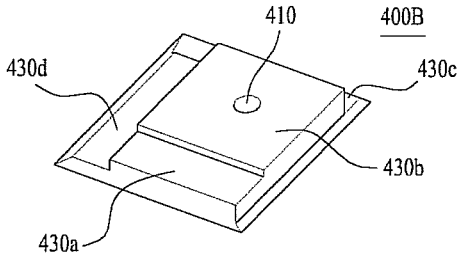

Referring to FIG. 6B, the tilt angle restriction device 400B may include a plurality of sides 430*a*, 430*b*, 430*c*, and 430*d* having different heights about the rotational center 410.

The tilt angle of the second hood 230 may be differently restricted by the sides 430*a*, 430*b*, 430*c*, and 430*d*. For example, in a case in which the tilt angle of the second hood 230 is restricted by the side 430*b* having the largest height, the second hood 230 may tilt at a relatively small angle. On the other hand, in a case in which the tilt angle of the second hood 230 is restricted by side 430*c* having the smallest height, the second hood 230 may tilt at a relatively large angle.

In certain embodiments, the 430*a*, 430*b*, 430*c*, and 430*d* may have different heights and may be randomly arranged, unlike what is shown in FIG. 6B.

Figure 6C:
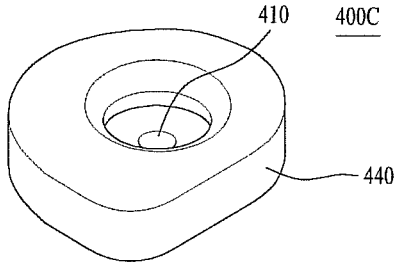

Referring to FIG. 6C, the tilt angle restriction device 400C may include a side 440, the radius of which is continuously changed about the rotational center 410.

In the example shown in FIG. 6C, the tilt angle of the second hood 230 may be changed within a continuous range unlike the examples shown in FIGS. 6A and 6B. That is, the tilt angle of the second hood 230 is not discretely restricted. In other words, the portion of the side 440 contacting the second hood 230 is changed according to rotation of the tilt angle restriction device 400C with the result that the tilt angle of the second hood 230 is restricted.

Figure 6D:
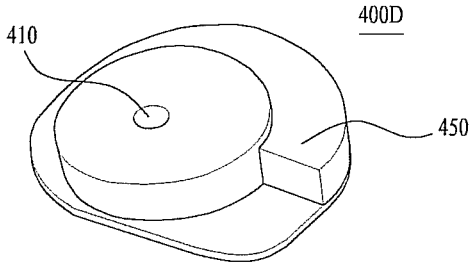

Referring to FIG. 6D, the tilt angle restriction device 400D may include a side 450, the height of which is continuously changed about the rotational center 410.

In the example shown in FIG. 6D, the tilt angle of the second hood 230 may be changed within a continuous range unlike the examples shown in FIGS. 6A and 6B. That is, the portion of the side 450 contacting the second hood 230 is changed according to rotation of the tilt angle restriction device 400D with the result that the tilt angle of the second hood 230 is restricted.

Figure 7:
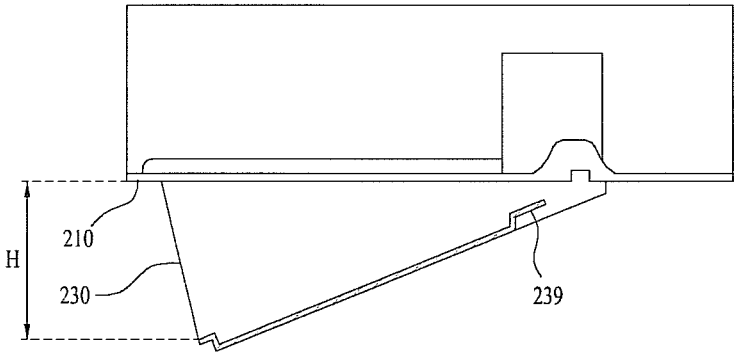
FIG. 7 is a sectional view taken along line B-B of FIG. 2, in which a second hood is tiled while a tilt angle restriction unit is not installed.

FIG. 7 is a sectional view taken along line B-B of FIG. 2 showing that the second hood 230 tilts in a state in which the tilt angle restriction device 400 is not installed.

Referring to FIG. 7, the second hood 230 tilts at the maximum angle (also see FIG. 5) in a state in which no tilt angle restriction device 400 is provided. At this time, the second hood 230 may have a tilt length H of, for example, about 46 mm.

That is, in a case in which a user wishes to tilt the second hood 230 at the maximum angle or in a case in which the second hood 230 does not interfere with the cooking device installed below the second hood 230 even when the second hood 230 tilts at the maximum angle, the second hood 230 may be used in the state shown in FIG. 7.

At this time, the second stopper 237 may prevent the tilt angle of the second hood 230 from deviating beyond the maximum set angle, thereby preventing the second hood 230 from being separated from the hood casing 210.

FIGS. 8 to 11 are sectional views taken along line B-B of FIG. 2 showing that the second hood 230 tilts according to rotation of the tilt angle restriction device. For reference, FIGS. 8 to 11 show examples of restricting the tilt angle of the second hood 230 using the tilt angle restriction device 400B shown in FIG. 6B. Consequently, a description with reference to FIGS. 8 to 11 may be substantially identically applied to FIGS. 6A, 6C and 6D.

The second hood 230 may include a location part 239 contacting the tilt angle restriction device 400 to restrict the tilt angle of the second hood 230. The location part 239 may form a portion of the lower side of the second hood 230.

The location part 239 may be formed in a step shape. When the location part 239 contacts the tilt angle restriction device 400, movement of the location part 239 is stopped. In addition, the location part 239 is supported by the tilt angle restriction device 400. For this reason, the location part 239 may be rigid. The step shape is formed by bending a general plate, and therefore, the step-shaped location part 239 may have relatively high rigidity.

Figure 8:
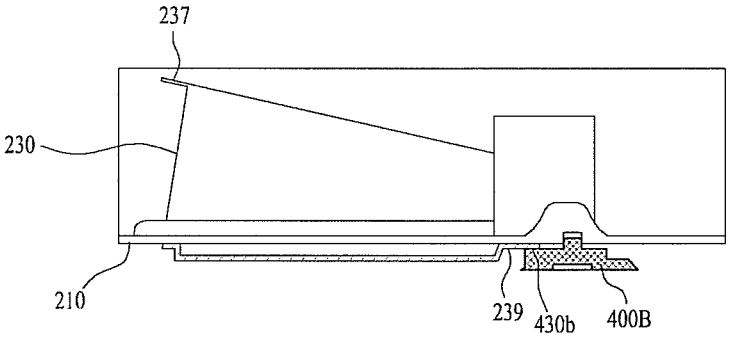
FIGS. 8 to 11 are sectional views taken along line B-B of FIG. 2, in which the second hood tilts based on rotation of the tilt angle restriction unit.

FIG. 8 shows an example in which tilting of the location part 239 is restricted by the side 430*b* of the restriction device 400B shown in FIG. 6B.

When the location part 239 contacts the side 430*b* as shown in FIG. 8, movement of the location part 239 is stopped. The side 430*b* is the highest one of the sides 430*a*, 430*b*, 430*c*, and 430*d* of the tilt angle restriction device 400B. In addition, the side 430*b* is in continuous contact with the location part 239.

In this case, therefore, the second hood 230 does not tilt. That is, the second hood 230 may have a tilt length H of 0 mm.

The example of FIG. 8 may be applied to a case in which a user does not wish to tilt the second hood 230. For example, the example of FIG. 8 may be used in a case in which a cooking device is installed below the second hood 230 such that the cooking device is adjacent to the second hood 230.

Figure 9:
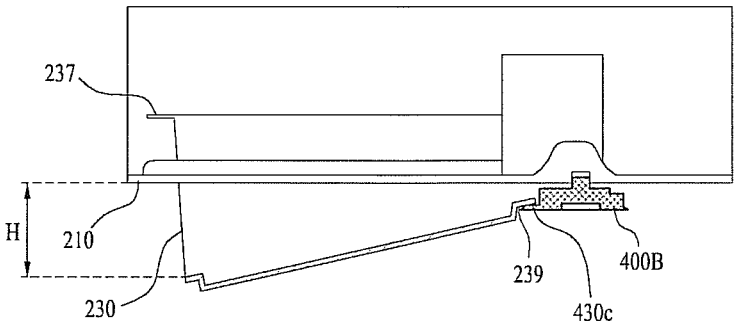

FIG. 9 shows an example in which tilting of the location part 239 is restricted by the side 430*c* of the restriction device 400B shown in FIG. 6B.

When the location part 239 contacts the side 430*c* as shown in FIG. 9, movement of the location part 239 is stopped. The side 430*c* is the lowest one of the sides 430*a*, 430*b*, 430*c*, and 430*d* of the tilt angle restriction device 400B. Consequently, the tilt angle of the second hood 230 at the side 430*c* is smaller than that of the second hood 230 in the case of FIG. 7 in which the tilt angle restriction device 400B is not installed but the tilt angle of the second hood 230 at the side 430*c* is larger than those of the second hood 230 at the other sides of the tilt angle restriction device 400B.

In this case, the second hood 230 may have a tilt length H of about 33 mm.

Figure 10:
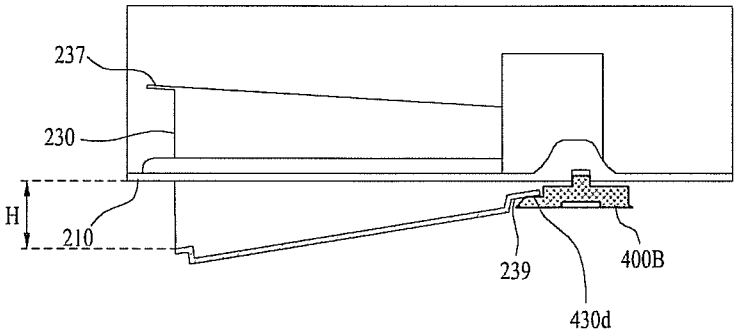

FIG. 10 shows an example in which tilting of the location part 239 is restricted by the side 430*d* of the restriction device 400B shown in FIG. 6B.

When the location part 239 contacts the side 430*d* as shown in FIG. 10, movement of the location part 239 is stopped. The side 430*d* is the third lowest one of the sides 430*a*, 430*b*, 430*c*, and 430*d* of the tilt angle restriction device 400B. Consequently, the tilt angle of the second hood 230 at the side 430*d* is larger than that of the second hood 230 in the case of FIG. 8 in which the second hood 230 does not tilt but the tilt angle of the second hood 230 at the side 430*d* is smaller than that of the second hood 230 in the case of FIG. 9.

In this case, the second hood 230 may have a tilt length H of about 24 mm.

Figure 11:
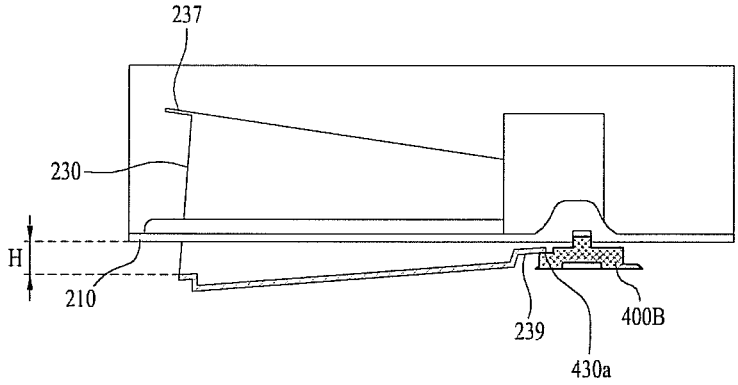

FIG. 11 shows an example in which tilting of the location part 239 is restricted by the side 430*a* of the restriction device 400B shown in FIG. 6B.

When the location part 239 contacts the side 430*a* as shown in FIG. 11, movement of the location part 239 is stopped. The side 430*a* is the second lowest one of the sides 430*a*, 430*b*, 430*c*, and 430*d* of the tilt angle restriction device 400B. Consequently, the tilt angle of the second hood 230 at the side 430*a* is larger than that of the second hood 230 at the highest side 430*b* but the tilt angle of the second hood 230 at the side 430*a* is smaller than that of the second hood 230 at the lowest side 430*c*

In this case, the second hood 230 may have a tilt length H of about 13 mm.

As described with reference to FIGS. 7 to 11, the tilt angle restriction device 400 is installed so as to be rotated about the rotational center 410. Consequently, the tilt angle restriction device 400 may be rotated to change the side of the tilt angle restriction device 400 contacting the location part 239.

That is, the user may separate the tilt angle restriction device 400 from the hood casing 210 or rotate the tilt angle restriction device 400 to adjust the tilt angle of the second hood 230.

Hereinafter, a microwave oven having a hood according to a second embodiment will be described in detail with reference to the accompanying drawings.

Figure 12:
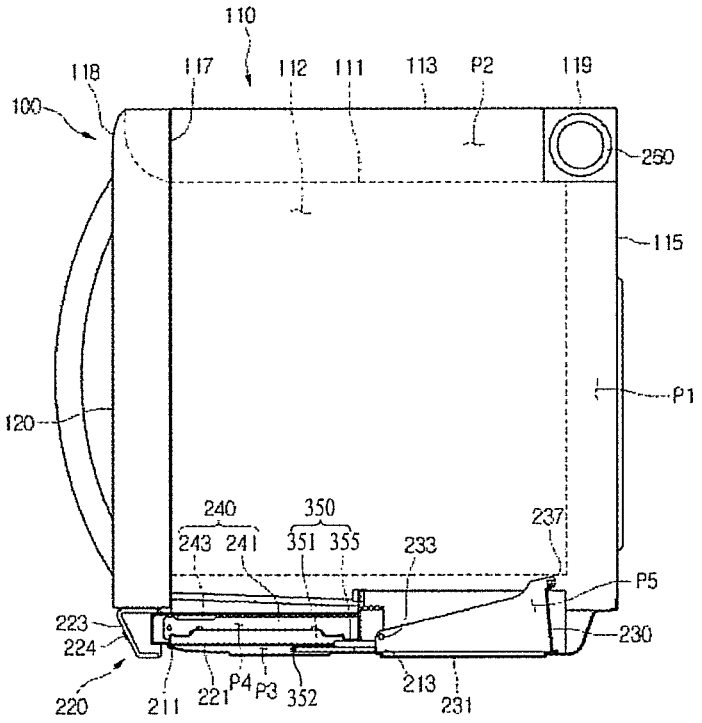
FIGS. 12 and 13 are longitudinal sectional views of a microwave oven having a hood, according to another embodiment as broadly described herein.
Figure 13:
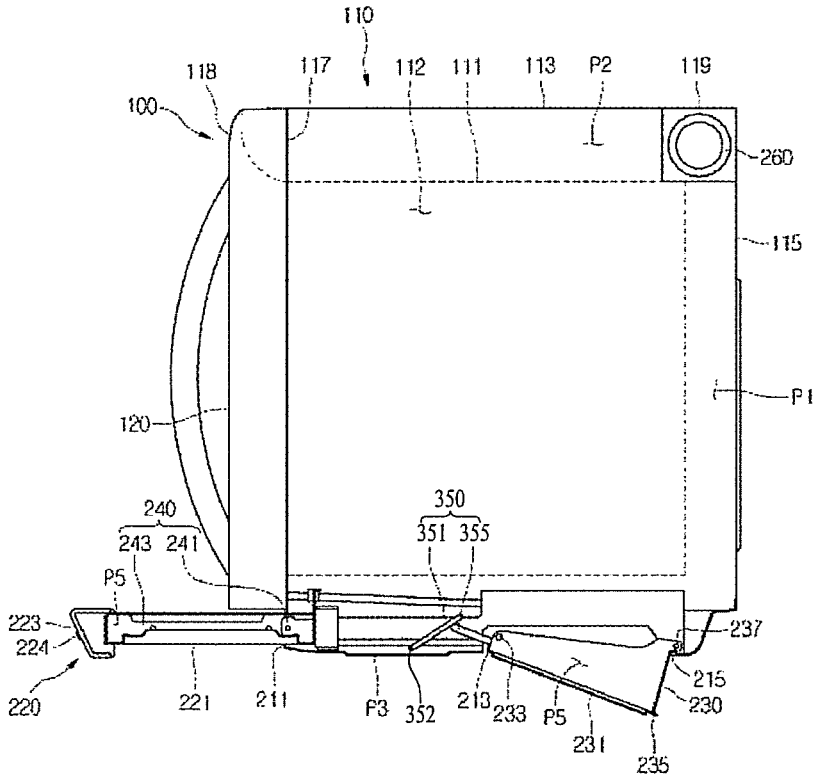

FIGS. 12 and 13 are side sectional views of a microwave oven having a hood according to a second embodiment. Components of the microwave oven according to the second embodiment are the same as or similar to those of the microwave oven according to the first embodiment will be denoted by the reference numerals used in FIGS. 2 to 5 and a detailed description thereof will be omitted.

Referring to FIGS. 12 and 13, in this embodiment, a tilting controller 350 includes first and second locking members 351 and 355. The first locking member 351 is rotatably installed in a hood casing 210. The second locking member 355 is provided at the front end of a second hood 230.

More specifically, rotation pins 352 are provided at the first locking member 351. The rotation pins 352 extend from opposite sides of the front end of the first locking member 351 in the horizontal direction. The first locking member 351 is rotated about the rotation pins 352 such that the first locking member 351 is located at a first position (see FIG.

12) and a second position (see FIG. 13). Rotation of the first locking member 351 is achieved according to storage and withdrawal of the first and second hoods 220 and 230 from the hood casing 210. That is, the first locking member 351 is located at the first position in a state in which the first hood 220 is located at a first storage position at which the first hood 220 is received in the hood casing 210. On the other hand, the first locking member 351 is rotated by the second hood 230 and located at the second position in a state in which the first hood 220 is located at a first withdrawn position at which the first hood 220 is withdrawn from the hood casing 210. To this end, in this embodiment, external force applied to the second hood 230 in the direction in which the second hood 230 is withdrawn from the hood casing 210 due to weight thereof is greater than external force applied to the first hood 220 located at the first storage position and external force applied to the second locking member 355, substantially the second hood 230, due to weight of the first locking member 351 located at the first position. In addition, external force applied to the second hood 230 in the direction in which the second hood 230 is withdrawn from the hood casing 210 due to weight thereof is greater than external force applied to the second locking member 355 due to weight of the first locking member 351 located at the first position.

The second locking member 355 maintains contact with one side of the first locking member 351 according to rotation of the first locking member 351. Alternatively, the second locking member 355 relatively moves along the first locking member 351 in contact with the first locking member 351. That is, when the first locking member 351 is located at the first position, the second locking member 355 maintains contact with the bottom of the first locking member 351. When the first locking member 351 is located at the second position, the second locking member 355 relatively moves along the bottom of the first locking member 351 in contact with the bottom of the first locking member 351 according to tilting of the second hood 230.

In this embodiment, when the first hood 220 is located at the first storage position at which the first hood 220 is received in the hood casing 210, the first locking member 351 is pressed by the first hood 220, i.e. external force is applied to the first locking member 351. As a result, the first locking member 351 remains at the first position, and therefore, tilting of the second hood 230 due to weight thereof is restricted.

On the other hand, when the first hood 220 is located at the first withdrawn position at which the first hood 220 is withdrawn from the hood casing 210, the external force applied to the first locking member 351 due to weight of the first hood 220 is removed. Consequently, only external force caused by weight of the second hood 230 is applied to the first locking member 351. As a result, the first locking member 351 is rotated about the rotation pins 352 and is then located at the second position. The second hood 230 also tilts with respect to the hood casing 210 due to weight thereof. At this time, the second locking member 355 relatively moves along the bottom of the first locking member 351 in contact with the bottom of the first locking member 351. Consequently, tilting velocity of the second hood 230 may be substantially reduced.

In the second embodiment, the microwave oven may have substantially the same section as that taken along line B-B of the drawing showing the first embodiment. Consequently, what was described in connection with the first embodiment may be equally applied to the second embodiment, and a detailed description thereof will be omitted.

In the above embodiments, the first hood slides with respect to the hood casing and the second hood tilts with respect to the hood casing. Based on movement with respect to the hood casing, therefore, the first hood and the second hood may be referred to as a sliding hood and a tilting hood, respectively.

In addition, the catching rib and the first and second stoppers serve to substantially restrict the tilting angle of the second hood with respect to the hood casing. Consequently, the catching rib and the first and second stoppers may be referred to as stopping members.

In the first embodiment as described above, the first locking member is provided at the first hood and the second locking member is provided at the second hood. Alternatively, the first locking member may be provided at the second hood and the second locking member may be provided at the first hood.

In the second embodiment as described above, on the other hand, external force applied to the second hood due to weight thereof is greater than external force applied to the second hood by the first locking member. Alternatively, an elastic member to apply elastic force, by which the second locking member is moved to the second position, to the second locking member may be provided.

Figure 14:
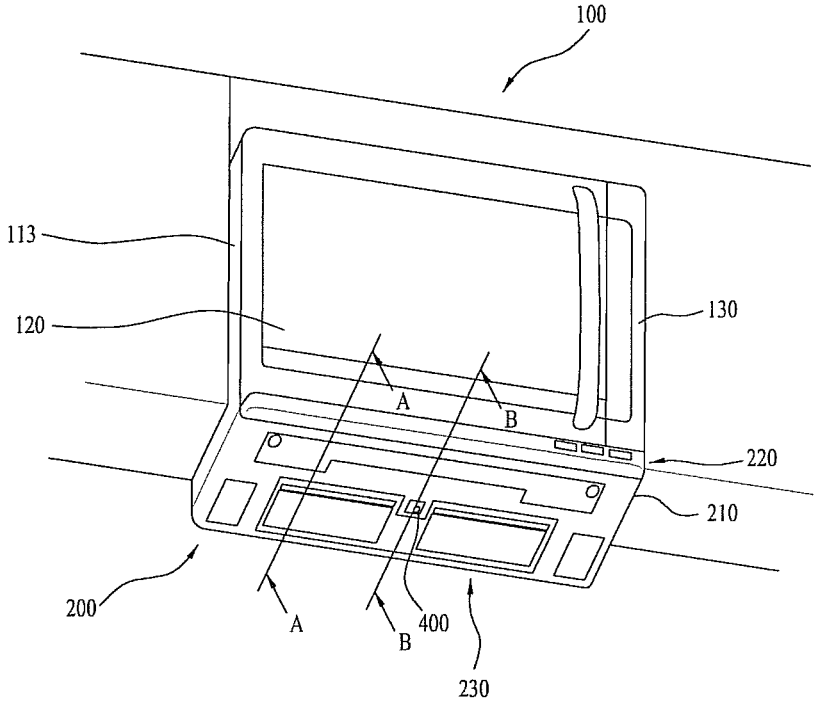
FIGS. 14 to 16 illustrate other forms of a microwave oven having a hood.
Figure 15:
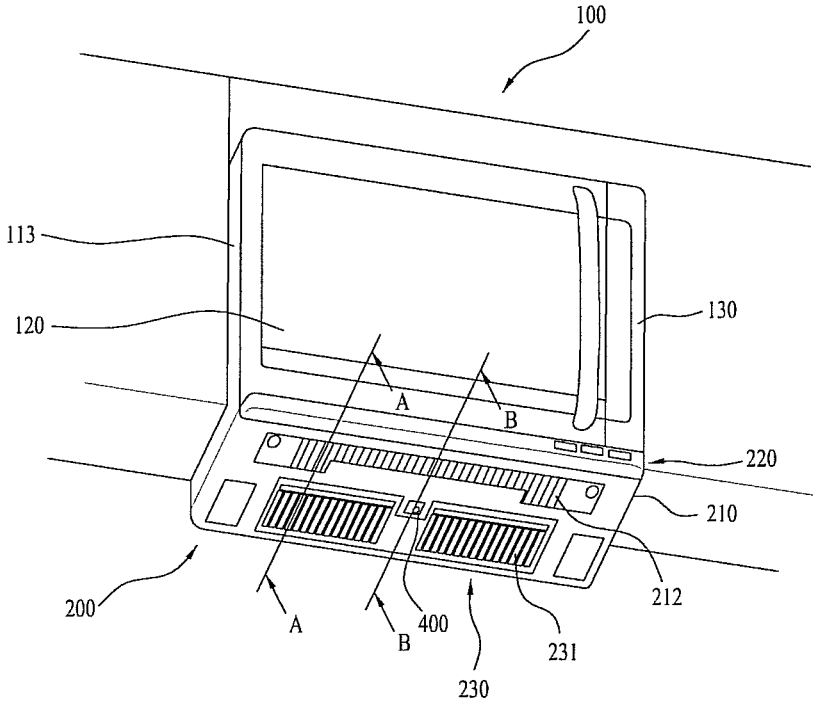
Figure 16:
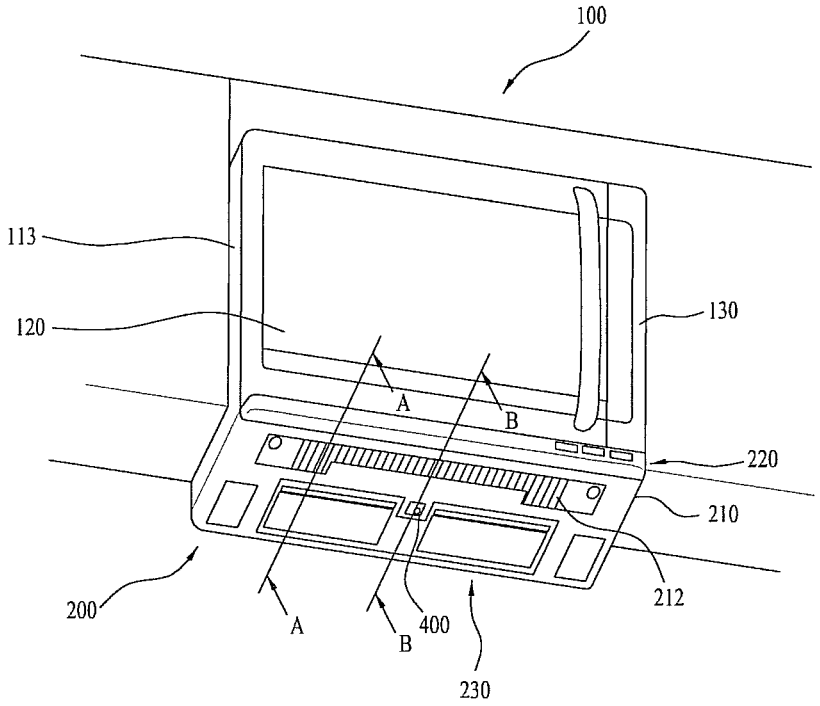

FIGS. 14 to 16 are views of other exemplary forms of a microwave oven having a hood. Technical concepts described in connection with the above embodiments may be included in the microwave ovens shown in FIGS. 14 to 16. Hereinafter, only differences between the above embodiments and the forms shown in FIGS. 14 to 16 will be described for the convenience of description. Technical contents described in connection with the above embodiments may be similarly applied to other components, which are not described, of the forms shown in FIGS. 14 to 16.

Referring to FIG. 14, the second intake port 231 is not formed at the second hood 230. Consequently, contaminants and other elements such as gas generated from a cooking device, such as a gas oven, is not introduced into the hood casing 210 through the second hood 230. The second hood 230 may function to guide gas based on the external shape thereof.

Referring to FIG. 15, an intake port 212 is formed at the hood casing 210. Consequently gas generated from a cooking device, such as a gas oven, may be suctioned through the second intake port 231 and the intake port 212.

Referring to FIG. 16, the second intake port 231 is not formed at the hood casing 210, but an intake port 212 is formed at the hood casing 210. Consequently, gas may be introduced into the hood casing 210 through the intake port 212 formed at the hood casing 210.

In the examples shown in FIGS. 14 to 16, an additional intake port may be provided at the first hood 220 such that a portion of the gas may be introduced into the hood casing 210 through the first hood 220.

As is apparent from the above description, the embodiments of the microwave oven having the hood as broadly described herein may have the following effects.

First, in a microwave oven as embodied and broadly described herein, the sliding hood slides forward and backward with respect to the microwave oven and the tilting hood tilts at a predetermined angle with respect to the microwave oven. Therefore, the area of the hood available to suction air containing contaminants may be increased and, at the same time, the distance between the microwave oven and the cooking device installed below the microwave oven may be decreased. Consequently, it may be possible to more efficiently suction air containing contaminants, thereby more efficiently preventing diffusion of air containing contaminants.

In addition, tilting of the tilting hood due to weight thereof may be selectively performed according to storage and withdrawal of the sliding hood. Therefore, it may be possible to tilt the tilting hood using a simpler construction.

Furthermore, it may be possible to decrease the tilting angle of the tilting hood when the cooking device installed below the tilting hood has a relatively large height and to increase the tilting angle of the tilting hood when the cooking device installed below the tilting hood has a relatively small height, thereby efficiently suctioning air.

A microwave oven having a hood is provided which may more efficiently prevent diffusion of air containing contaminants.

A microwave oven having a hood is provided which may more efficiently suction air containing contaminants.

A microwave oven having a hood is provided that may be used regardless of a height of a device installed below the microwave oven having the hood.

It is to be understood that both the foregoing general description and the detailed description of the various embodiments are exemplary and explanatory and are intended to provide further explanation of the features disclosed herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A microwave oven, comprising:

a cooking chamber;

a hood casing positioned below the cooking chamber;

a first hood slidably coupled to the hood casing such that the first hood is selectively withdrawn from and received in the hood casing as the first hood slides forward and backward with respect to the hood casing;

a second hood total-ably coupled to the hood casing such that the second hood is selectively withdrawn from and received in the hood casing as the second hood rotates with respect to the hood casing; and a tilting controller configured to selectively restrict tilting of the second hood, wherein the tilting controller includes a tilt angle restriction device installed adjacent to a rotational axis of the second hood and configured to restrict a tilt angle of the second hood, wherein the second hood includes a location arm configured to selectively contact a corresponding portion of the tilt angle restriction device based on the tilt angle of the second hood, wherein the tilt angle restriction device is installed at a bottom portion of the hood casing, and wherein the tilt angle rotation device is rotatable about an axis that extends in a vertical direction with respect to a bottom of the hood casing.

2. The microwave oven of claim 1, wherein the tilt angle restriction device is provided at an intermediate lateral portion of the hood casing.

3. The microwave oven of claim 1, wherein the tilt angle restriction device includes a plurality of contact surfaces arranged about a rotational center of the tilt angle restriction device, the plurality of contact surfaces being positioned at different radial distances from the rotational center.

4. The microwave oven of claim 3, wherein a horizontal cross section of the tilt angle restriction device is polygonal.

5. The microwave oven of claim 1, wherein the tilt angle restriction device includes at least four contact surfaces arranged about a rotational center of the tilt angle restriction device, the at least four contact surfaces being positioned at different radial distances from the rotational center.

6. The microwave oven of claim 1, wherein the tilt angle restriction device includes a curved contact surface arranged about a rotational center of the tilt angle restriction device, and wherein a radius of curvature of the curved contact surface continuously changes along a periphery thereof.

7. The microwave oven of claim 1, wherein the tilt angle restriction device includes a plurality of contact surfaces arranged about a rotational center of the tilt angle restriction device, the plurality of contact surfaces having different heights.

8. The microwave oven of claim 7, wherein the plurality of contact surfaces are arranged such that a step is formed between adjacent contact surfaces.

9. The microwave oven of claim 1, wherein the location arm of the second hood has a stepped shape.

10. The microwave oven of claim 1, further including a first intake port provided in the hood casing and a second intake port provided in the second hood.

11. The microwave oven of claim 1, wherein the tilting controller further includes:

a first locking member provided at one of the first hood or the second hood; and a second locking member provided at the other of the first hood or the second hood.

12. The microwave oven of claim 11, wherein the first locking member is configured to move in response to withdrawal of the first hood from the hood casing to allow tilting of the second hood.

13. The microwave oven of claim 11, wherein the second locking member is configured to maintain contact with one side of the first locking member when the first hood is received in the hood casing to restrict tilting of the second hood.

14. A microwave oven, comprising:

a cooking chamber; and a hood assembly coupled to the cooking chamber, the hood assembly including:

casing;

a first hood slidably coupled to the casing, the first hood sliding horizontally between a fully closed position in which the first hood is fully received in the casing and a fully open position in which the first hood is slidably extended forward from a front of the casing;

a second hood rotatably coupled to the casing, the second hood rotating between a fully closed position in which the second hood is fully received in the casing and a fully open position in which the second hood is rotated away from the casing at a predetermined angle; and a rotation limiter coupled to the casing, wherein a location arm of the second hood is configured to contact the rotation limiter as the second hood rotates relative to the casing to establish a tilt angle of the second hood, and wherein the rotation limiter is installed at a bottom portion of the casing and is rotatable about an axis that extends in vertical direction with respect to a bottom of the casing.

15. The microwave oven of claim 14, wherein the second hood is configured to rotate from the fully closed position to the fully open position in response to the first hood sliding from the fully closed position to the fully open position.

16. The microwave oven of claim 14, wherein the tilt angle of the second hood corresponds to a contact point of the location arm on the rotation limiter.

17. The microwave oven of claim 14 wherein the rotation limiter includes:

a plurality of contact surfaces arranged surrounding a center of rotation of the rotation limiter and configured to selectively contact the location arm of the second hood, the plurality of contact surfaces being arranged at different radial distances from the center of rotation such that the plurality of contact surfaces respectively correspond to a plurality of tilt angles of the second hood.

18. The microwave oven of claim 14 wherein the rotation limiter includes:

a curved contact surface arranged surrounding a center of rotation of the rotation limiter and configured to selectively contact the location arm of the second hood, and wherein a radius of curvature of the curved contact surface changes continuously along a periphery thereof such that a tilt angle of the second hood corresponds to a radial distance from the center of rotation to the curved contact surface.

* * * * *